US006107790A

United States Patent [19]

Sawazaki et al.

[11] Patent Number: 6,107,790

[45] Date of Patent: Aug. 22, 2000

[54] IGNITION COIL FOR INTERNAL COMBUSTION ENGINE

[75] Inventors: Nobuyuki Sawazaki; Takafumi Narishige; Shigemi Murata; Mitsuru Koiwa; Yutaka Ohashi, all of Hyogo, Japan

[73] Assignee: Mitsubishi Denki Kabushiki Kaisha, Tokyo, Japan

[21] Appl. No.: 08/206,669

[22] Filed: Mar. 7, 1994

[30] Foreign Application Priority Data

Jul. 9, 1993 [JP] Japan ..... 5-170416

[51] Int. Cl.[7] ..... H05F 1/00

[52] U.S. Cl. ..... 323/371; 123/634; 123/647

[58] Field of Search ..... 323/361, 345, 323/346, 350, 351, 362, 371; 336/92, 96; 29/602.1; 123/634, 647

[56] References Cited

U.S. PATENT DOCUMENTS

| | | | |
|---|---|---|---|
| 4,248,201 | 2/1981 | Tsutsui et al. | 123/647 |
| 4,985,984 | 1/1991 | Umezaki | 29/602.1 |
| 5,109,209 | 4/1992 | Ida et al. | 336/96 |
| 5,124,680 | 6/1992 | Maekawa | 336/96 |
| 5,172,302 | 12/1992 | Taruya et al. | 361/386 |
| 5,186,154 | 2/1993 | Takaishi et al. | 123/634 |
| 5,313,927 | 5/1994 | Takaishi | 123/634 |
| 5,349,320 | 9/1994 | Suzuki et al. | 336/92 |

FOREIGN PATENT DOCUMENTS

| | | | |
|---|---|---|---|
| 0440395A1 | 8/1991 | European Pat. Off. . | |
| 4013131A1 | 10/1990 | Germany . | |
| 4102145A1 | 7/1992 | Germany . | |
| 587034 | 4/1993 | Japan | F02P 15/00 |

OTHER PUBLICATIONS

Patent Abstracts of Japan E–703, Jan. 13, 1989, vol. 13/No. 16.

*Primary Examiner*—Shawn Riley
*Attorney, Agent, or Firm*—Sughrue, Mion, Zinn, Macpeak & Seas, PLLC

[57] ABSTRACT

A plurality of ignition coils and a plurality of switching assemblies are accommodated in one case, and a wire harness which interconnects the winding, connectors, and the switching assembly is formed as a unit using a plurality of conductors by means of a resin. In addition, respective electrical connections are established by welding, and soldering is disused. Thereby, it is provided an ignition device in which troublesome wiring between a coil and a switching assembly is eliminated and the reliability of electrical connections is improved, and which is compact and lightweight.

11 Claims, 10 Drawing Sheets

IGNITION COIL FOR INTERNAL COMBUSTION ENGINE

BACKGROUND OF THE INVENTION

This invention relates to an ignition coil for an internal combustion engine.

FIG. 12A is a diagram illustrating an ignition device using a conventional ignition coil for an internal combustion engine. Reference numeral 91 denotes a computer; 3, a switching assembly connected to the computer 91; 58, an ignition coil connected to the switching assembly 3; 4, an electronic device having an additional function and connected to the switching assembly 3; 96, a bracket for mounting the switching assembly 3, the ignition coil 58, and the electronic device 4 thereon; 95, a bolt for fixing the ignition coil 58 to the bracket 96; and 94, a wire harness for connecting the switching assembly 3, the ignition coil 58, and the electronic device 4. FIG. 12B is a cross-sectional view illustrating the ignition coil 58.

Referring to FIG. 13, a description will be given of the operation. An ignition signal processed and output by the computer 91 in correspondence with the position of a crankshaft of an engine is received by the switching assembly 3. The switching assembly 3 is repeatedly turned on and off by the ignition signals, whereby a primary current to a primary winding 51 of the ignition coil 58 is supplied or interrupted. When the primary current is interrupted, a high voltage is generated across both ends of a secondary winding 52 by an induced electromotive force via a core 55. The generated high voltage is supplied to an ignition plug 92 by a high-tension cord (not shown), is discharged in a plug gap, and ignites an air-fuel mixture compressed in a combustion chamber of the engine. It should be noted that the electronic device 4 has the additional function of sending back to the computer 91 a confirmation signal as to where or not the proper primary current is flowing in correspondence with the state of current flowing across the primary winding 51.

Since the conventional ignition device for a multi-cylinder internal combustion engine is comprised of the switching assembly, the electronic device with an additional function, the bracket, the wire harness, and the plurality of ignition coils, there have been problems in that its size and weight are large, the assembly is complicated, there is a possibility of an erroneous connection being made, and the reliability of the electrical connections is low, and that the device is expensive as a result.

SUMMARY OF THE INVENTION

The present invention has been devised to overcome the above-described problems, and its object is to obtain a device which makes it possible to disuse the harness for interconnecting the devices of an ignition system, facilitates assembly, has high reliability of electrical connections, and is compact and inexpensive.

In the ignition device for an internal combustion engine in accordance with the present invention, instead of a wire harness for electrically connecting various functional components, conductors formed integrally by a resin are used, and a plurality of connectors at input and output ends of the functional components are bundled together by the integrated conductors.

Furthermore, in a manufacturing method in accordance with the present invention, electrical connections among coil windings, connectors, switching assemblies, and integrated circuits are established by connection with the integrated conductors using a resin.

The integrated conductors in accordance with the present invention integrate the intricate connections of the ignition device, and are made compact and lightweight, so that they are easy to handle and can be readily incorporated into the case. Since the wire harness is made unnecessary, erroneous connections are not encountered. When the functional components are electrically connected, welding is employed instead of soldering, so that the reliability of the welded portions improve, and it is possible to provide a low-cost ignition coil as a whole.

DETAILED DESCRIPTION OF PREFERRED EMBODIMENTS

First Embodiment

Figure 1A:
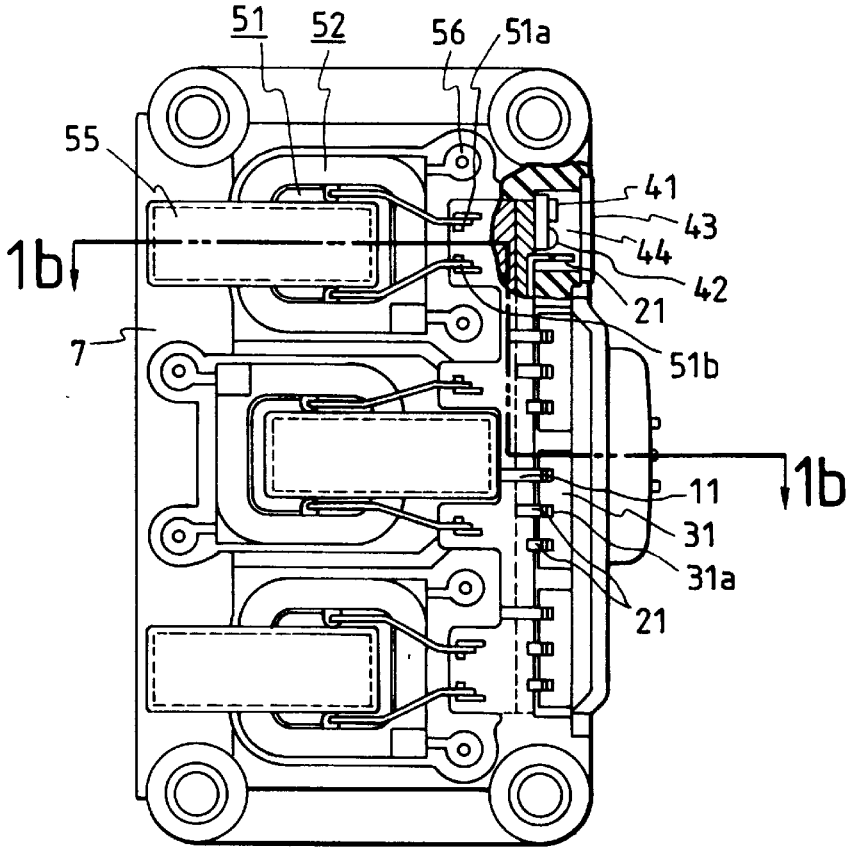
FIG. 1A illustrates an ignition device in accordance with an embodiment of the present invention.

Referring now to the drawings, a description will be given of an embodiment of the present invention.

Figure 1B:
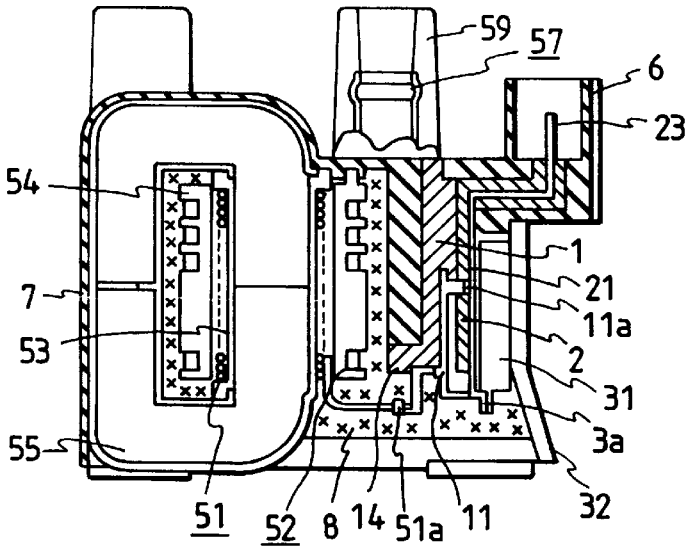
FIG. 1B is a cross-sectional view thereof.

FIG. 1A is an assembly drawing of an ignition coil illustrating an embodiment of the present invention, and FIG. 1B is a cross-sectional view thereof.

In the drawings, reference numeral 55 denotes a closed magnetic path core which has a gap formed by causing ends of a U-shaped iron core to abut against each other; 51, a primary winding wound around the core 55 via a primary bobbin 53; 52, a secondary winding wound around the periphery of the primary winding 51 via a secondary bobbin 54; and 7, a case for accommodating 51 to 55. Insert-molded in the case 7 are a first integrated conductor 1 in which a plurality of conductors 11 are integrated by a resin and a second integrated conductor 2 in which a plurality of conductors 21 are integrated by the resin. The conductor of the second integrated conductor forms a terminal 23 of a connector 6.

The first integrated conductor 1 is electrically connected to both ends 51*a* and 51*b* of the primary winding 51 by fusing. A plurality of switching assemblies 31 mounted on a heat sink 32 bonded to the first and second integrated conductors and the case 7 are electrically connected at 3*a* by welding. In addition, the conductors 11 and 21 of the first and second integrated conductors are welded at 11*a* for electrical connection.

It should be noted that a resin wall 14 of the first integrated conductor 1 has a shape for causing the first and second integrated conductors to be brought into close contact with a mold when the first and second integrated conductors are inserted into the mold of the case 7. The resin wall 14 serves as an influx-preventing wall for preventing the resin at the time of molding the case 7 from flowing to the connecting portions 51*a* and the like of the conductors 11 and 21.

Both ends of the secondary winding 52 are connected to terminals 56 pressure fitted in the secondary bobbin 54, and the terminals 56 are connected (not shown) to high-tension tower terminals 57 of the case 7. Numeral 8 denotes an insulating resin which is cast after the incorporated parts 51 to 55 are fitted in the case 7.

After an HIC 41 having an additional function is accommodated in a space 44 formed in a portion of the case 7, and is bonded in the case, the terminal of 41 and some conductors 21 of the integrated conductor 2 are welded at 42. The surface of the HIC is bonded and sealed by a cover 43 after the surface is coated with a gel or the like.

Figure 2C:
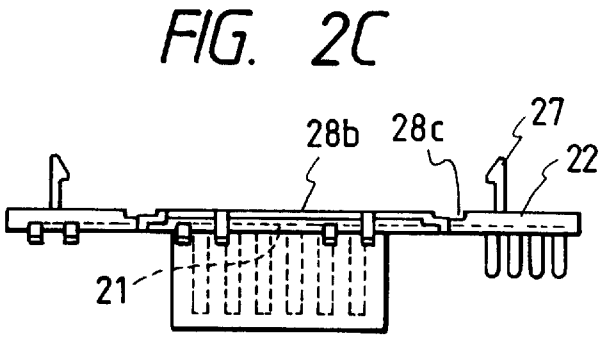
FIGS. 2A to 2C are diagrams illustrating a second integrated conductor in accordance with the embodiment of the present invention.

Then, a description will be given of a configuration of the second integrated conductor and a manufacturing method thereof. FIG. 2A shows the configuration of the second integrated conductor, in which numeral 21 denotes a conductor formed of sheet metal stamping in the drawing; 22, a resin for finally integrating the plurality of conductors; and 23, a portion of the case which serves as a connector terminal. Numerals 24*a* to 24*c* denote weld-connected ends of the plurality of switching assemblies 31 for connection to the ignition signal input terminals; 25*a* to 25*c*, emitter (GND) connecting terminals; and 26 denotes a weld-connecting end connected to the HIC 41 having the additional function.

Figure 2B:
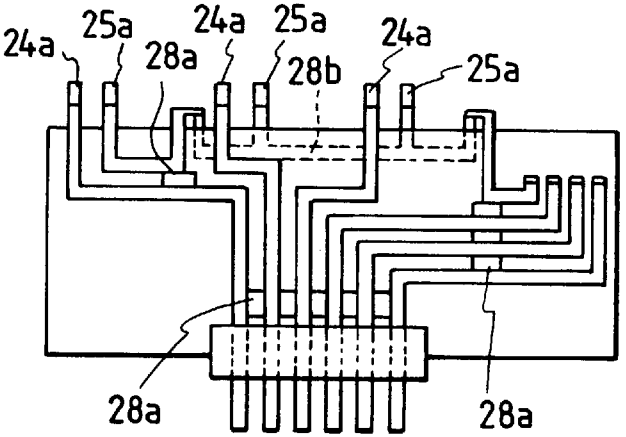
Figure 2A:
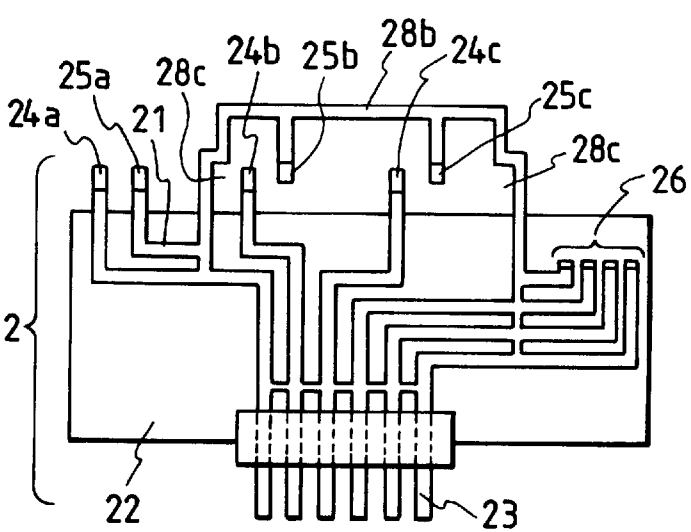

To show the process for fabricating the second integrated conductor, after the conductors 21 in FIG. 2A are insert-molded and the resin 22 is applied thereto, portions of the conductor are cut off at 28*a* shown in FIG. 2B, and the conductors are electrically separated in correspondence with the electrical functions of the conductors. It should be noted, however, that the conductors are structurally integrated by the resin 22. Subsequently, the common GND conductor of 28*b* is bent at a position 28*c*.

Since the resin 22 exists between 28*b* and the other conductors 21, the mutual electrical insulation is maintained. In the above process, a series of operations involving the sheet metal stamping of a conductor sheet metal material using a die, resin molding using a die, conductor cutting using a die, and conductor bending using a die can be implemented accurately with high reliability in a short pitch time by an automation facility. As a result, the plurality of conductors 21 can be integrated by the resin, and the integrated conductor exhibiting a complicated connection form of a multi-layered structure shown by the relation between 28 and 21 can be realized at low cost.

Figure 3A:
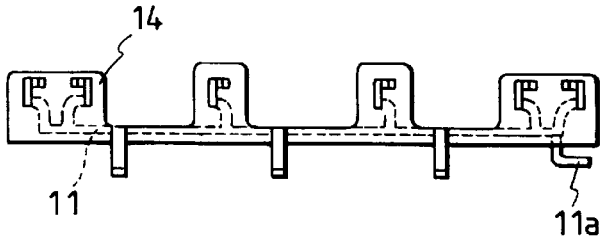
FIGS. 3A and 3B are diagrams illustrating a first integrated conductor in accordance with the embodiment of the present invention.

FIG. 3A shows a configuration of the first integrated conductor. Numeral 11 denotes the plurality of conductors; 12, a resin for integrating 11; 15, a fusing portion with respect to the primary winding; 16, a connecting end with a collector terminal of the switching assembly 31; and 11*a*, a weld-connecting end for connecting conductors for power supply lines for the first and second conductors.

It goes without saying that the first integrated conductor 1 is fabricated by the same manufacturing process as that for the above-described second integrated conductor.

Figure 3B:
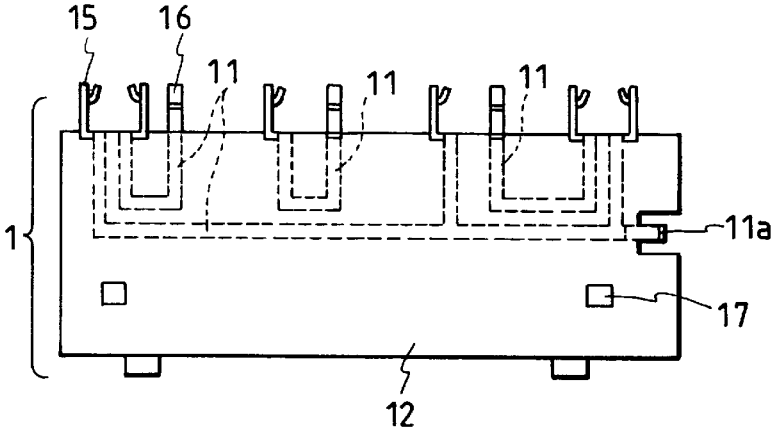
Figure 4:
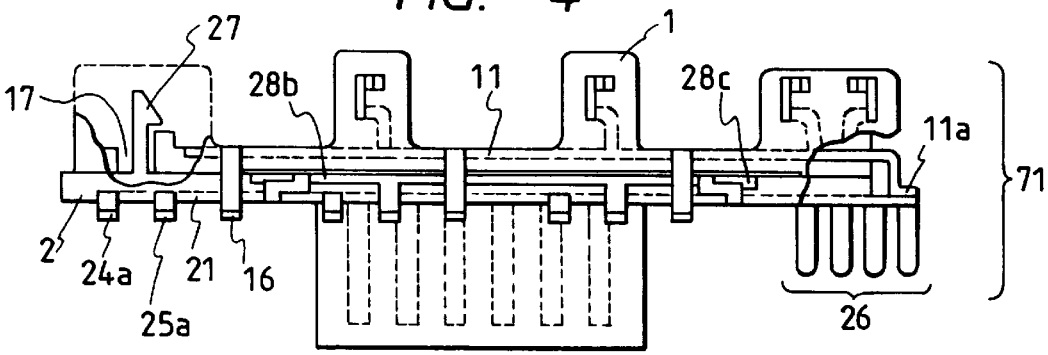
FIG. 4 is a diagram illustrating a third integrated conductor in which the first and second integrated conductors are integrated in accordance with the embodiment of the present invention.

In FIGS. 2C and 3B, numerals 27 and 17 denote a resiliently retaining portion (27 in FIG. 2C) for connecting the first and second integrated conductors, and a fitting portion (17 in FIG. 3B) corresponding thereto. The first and second integrated conductors are mechanically integrated by combining 17 and 27, as shown in FIG. 4, and a third integrated conductor is formed by electrically connecting the power-supply-line conductors at 11*a* by means of welding. The common GND conductor 28*b* is secured by the resin of the first and second integrated conductors, and insulation with respect to the other conductors is achieved. Numeral 28*c* denotes a resin cavity for accommodating 28*b* provided on the second integrated conductor 2.

Since the power-supply-line conductors are integrated into the third integrated conductor 71 in the above-described manner, management of the components becomes less troublesome, and the time for insertion of the insert into the mold during the molding of the case 7 can be reduced, and the pitch time for molding can be shortened.

Figure 11B:
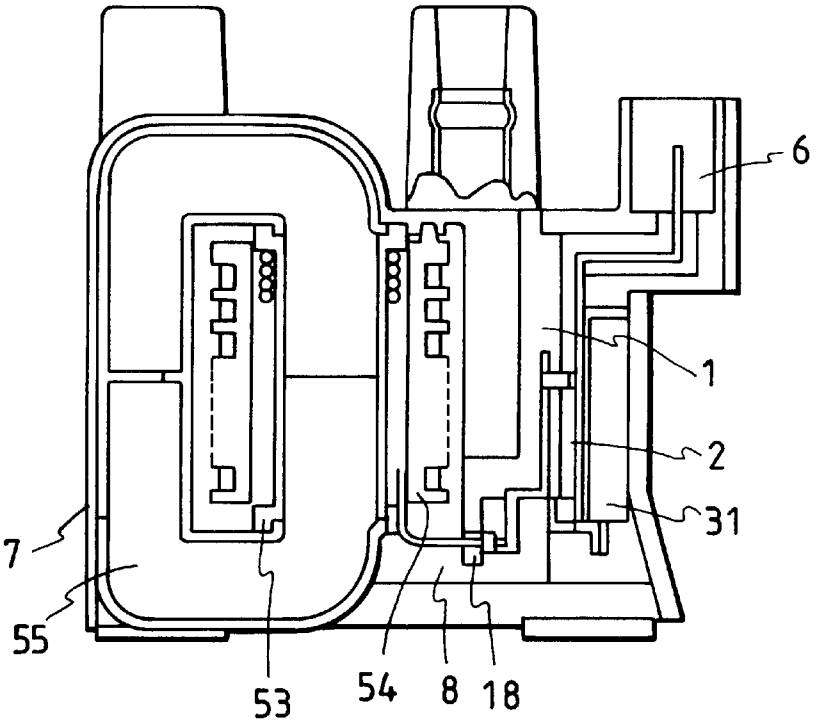
FIGS. 11A and 11B illustrate a further embodiment of the present invention.
Figure 11A:
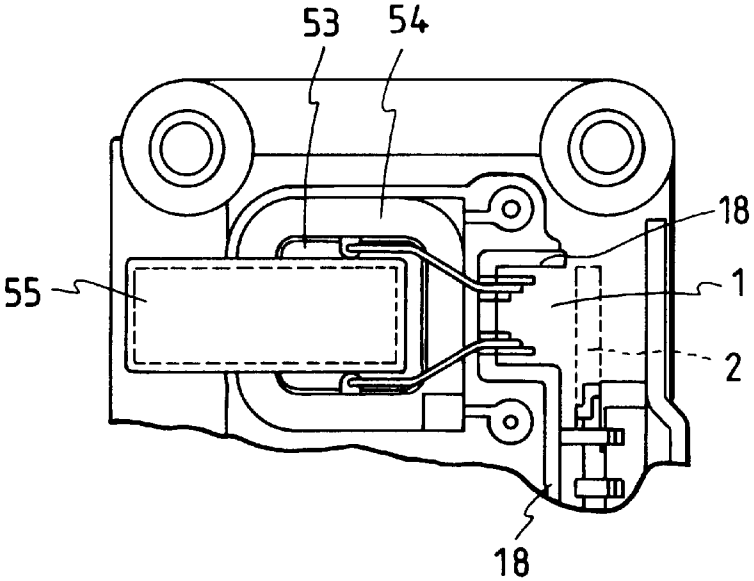
Figure 12A:
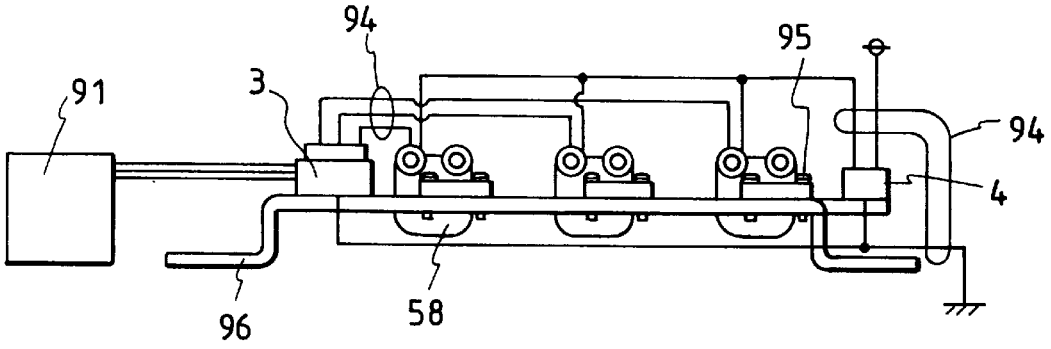
FIG. 12A is a schematic diagram illustrating a conventional example.
Figure 12B:
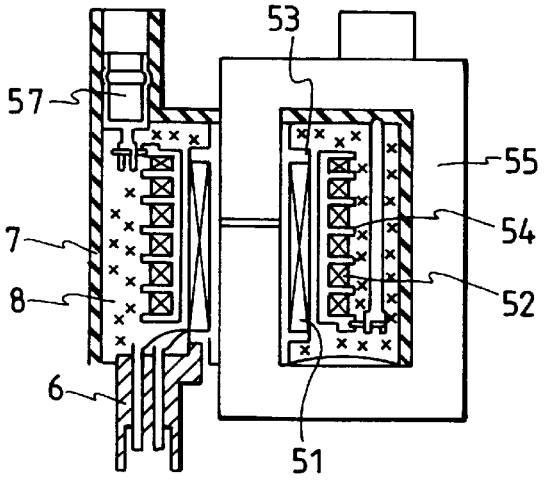
FIG. 12B is a cross-sectional view illustrating an ignition coil in accordance with the conventional example.
Figure 13:
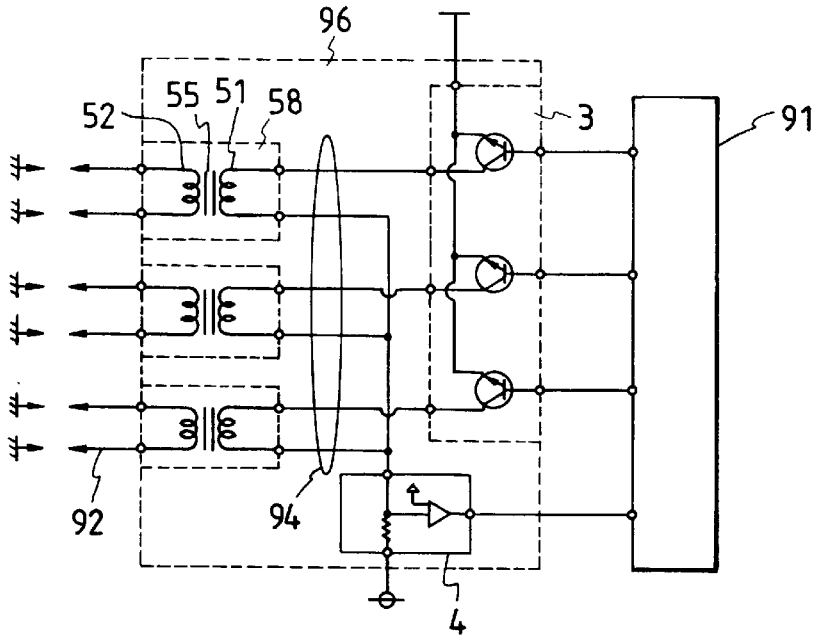
FIG. 13 is a circuit diagram illustrating an ignition device in accordance with the conventional example.

Here, a description will be given of the welding (3*a* and 11*a* in FIG. 1B) of the conductors and the terminals as well as the fusing of the primary winding and the conductor. In this device, electrically connecting portions are sealed from the surrounding portions by means of the cast insulating resin 8. In such a state, mechanical stress occurs in the connecting portions owing to differences in the coefficient of thermal expansion among the various members at the time of high or low temperature. For instance, in soldering or the like which has been conventionally employed, breakage of the connecting portions due to a lack of strength is liable to occur. By connecting the connecting portions by welding, the strength of the connecting portions can be improved, and the uniform quality and the facilitated automation can be achieved. However, there is a possibility of occurrence of welding slag at the time of welding depending on a combination of the materials of the conductors that are connected. If welding slag scatters to a high-tension portion (in the surroundings of 52 in FIG. 1B) of the ignition coil, a malfunction such as the leakage of the high voltage occurs. Hence, the aforementioned malfunction can be prevented by providing the integrated conductor 1 with resin walls 18 shown in FIGS. 11A and 11B.

Next, an insulating coating is provided on the surface of the conductor of the primary winding 51, and it has conventionally been necessary to perform an operation for mechanically scraping off the insulating coating before soldering in the connection of the conductor to the terminal, which required time and trouble and resulted in high cost. In fusing, the terminal of a U-shape or other similar shape at the portion 51*a* of each conductor 11 is clamped by a jig, and a large current is allowed to flow between jaws of the jig to generate heat at the moment of caulking, thereby allowing the insulating coating resin to be fused and removed. Thus, the conventionally required trouble of removing the film is unnecessary, the operation ensures high reliability and facilitates automation, and a reduction of cost is possible.

Figure 14:
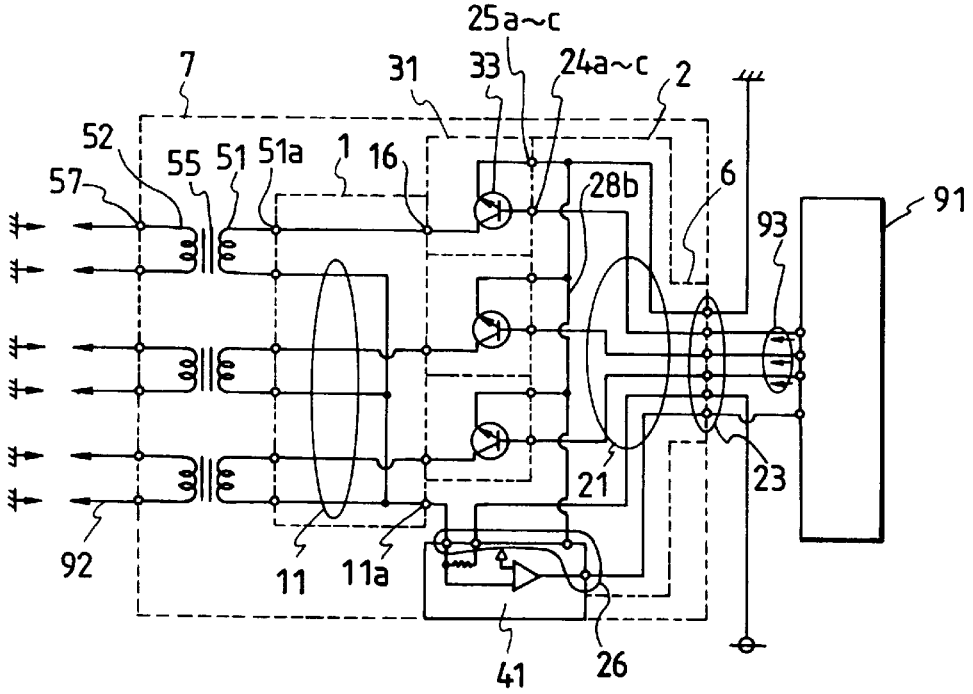
FIG. 14 is a circuit diagram illustrating the ignition device in accordance with the present invention.

Referring now to FIG. 14, a description will be given a of the operation of the embodiment. On-off ignition signals 93 that are processed and sequentially output by a computer 91 in correspondence with the position of the crankshaft of the engine are consecutively received by the plurality of switching assemblies 31 at 24*a* to 24*c*. The switching assemblies 31 switch power transistors 33 on and off in response to on-off ignition signals 93, thereby supplying or interrupting the supply current to each primary winding 51. A high voltage is sequentially generated at both ends of each secondary winding by an induced electromotive force each time the primary current is interrupted. This high voltage is supplied to an ignition plug 92 of each predetermined cylinder through the high-tension cord (not shown), is discharged in the plug gap, and ignites the air-fuel mixture compressed in the combustion chamber of the engine. It should be noted that the HIC 41 with the additional function sends back to the computer 91 a confirmation signal as to whether or not a proper primary current is flowing depending on the state of the current flowing across the primary winding 51.

Second Embodiment

Figure 5A:
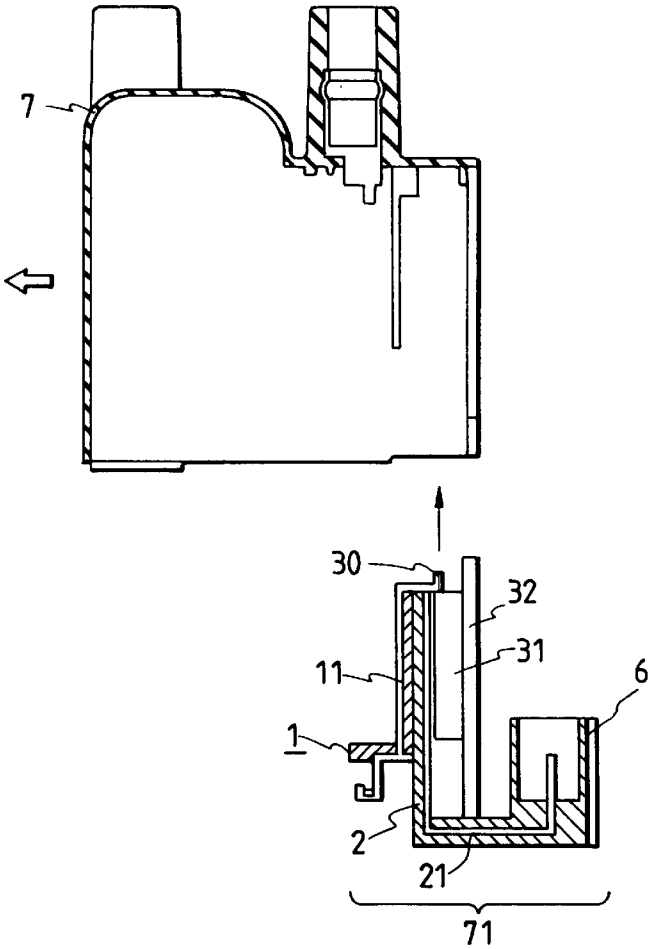
FIGS. 5A and 5B illustrate another embodiment of the present invention.
Figure 5B:
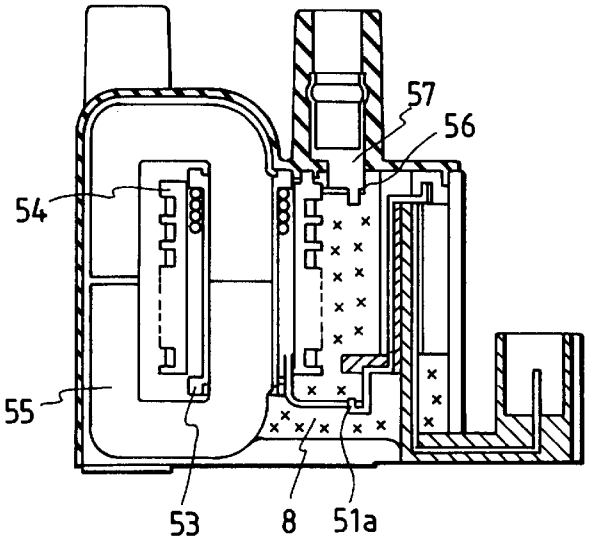

Although in the foregoing embodiment the first integrated conductor 1 and the second integrated conductor 2 are insert-molded in the case 7, the third integrated conductor 71 in which 1 and 2 are combined, as shown in FIGS. 5A and 5B, may be post-inserted into the case 7 in the same way as the other components 51 to 55.

In this case, since the number of steps involved in the insertion of the third integrated conductor 71 into the mold is reduced at the time of the molding of the case 7, the pitch time for molding the case 7 is shortened. However, as can be appreciated from a comparison of FIG. 5B with FIG. 1B, the connector 6 projects outside the case, so that the overall dimensions of the ignition coil tend to become large. In FIGS. 1 and 5A and 5B, an embodiment is shown in which both the first and second integrated conductors are insert-molded (FIG. 1) and post-inserted (FIGS. 5A and 5B) into the case 7. However, it goes without saying that the same holds true of a case where either one of the first and second integrated conductors is insert-molded, and the other is post-inserted. In this case, it suffices if the connections 11*a* of the power-supply-line conductors of the conductors 11 and 21 are connected before or after the process of connecting 51*a* after the components are incorporated in the case 7.

Third Embodiment

Figure 6:
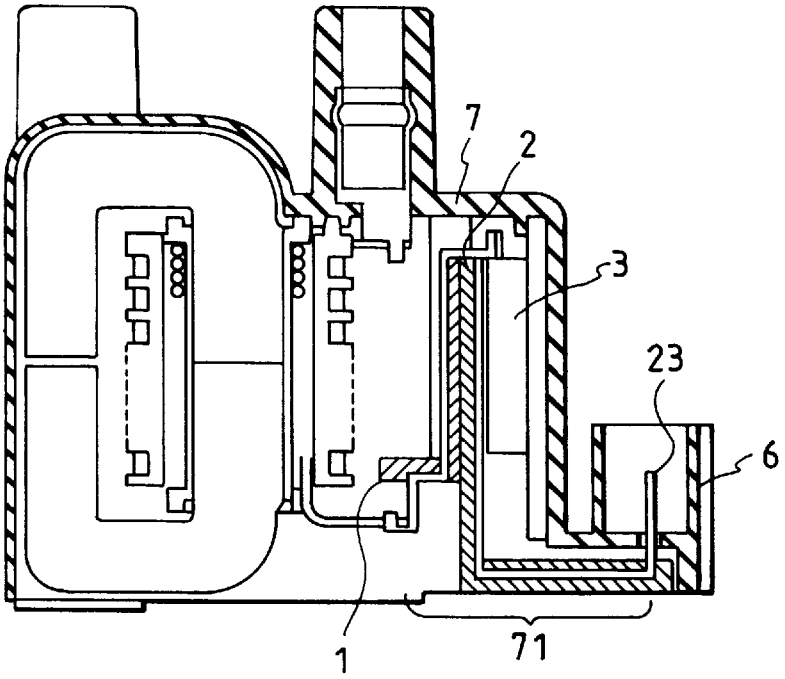
FIG. 6 illustrates still another embodiment of the present invention.

Although in the foregoing embodiments a description has been given of a case in which the connector terminals and the connector housing are formed as a unit, the integrated conductor 71 constituted by the integrated conductors 1 and 2 with the connector terminals 23 may be post-inserted into the case 7 with the connector housing 6, as shown in FIG. 6.

Fourth Embodiment

Figure 7:
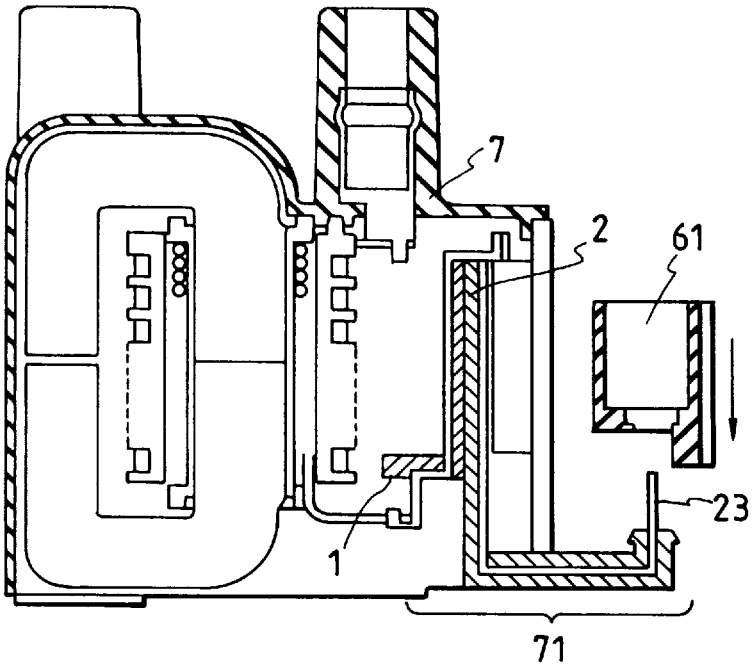
FIG. 7 illustrates a further embodiment of the present invention.

Although in the third embodiment the connector terminals are post-inserted, only a connector housing portion 61 may be post-inserted into the integrated conductor 71, as shown in FIG. 7. If a several kinds of connector housing are fabricated in advance in this manner, it is possible to cope with a mating harness of a different shape by using one kind of case. It goes without saying that, also in the case of the type in which the integrated conductor 71 shown in FIG. 1 is insert-molded into the case 7, only the connector housing portion can similarly be post-inserted.

Fifth Embodiment

Figure 8A:
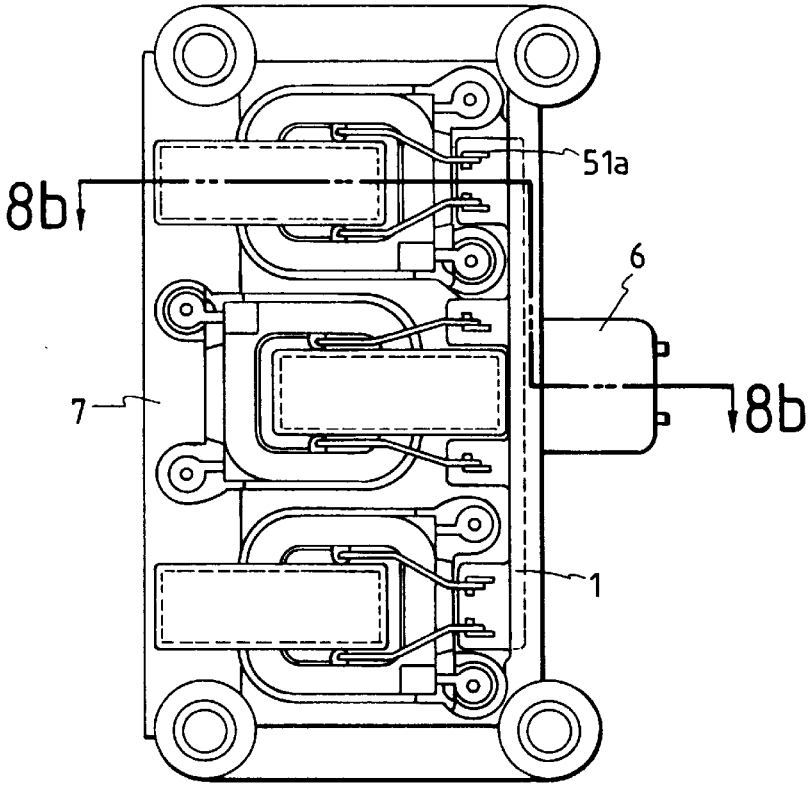
FIGS. 8A and 8B illustrate a still further embodiment of the present invention.
Figure 8B:
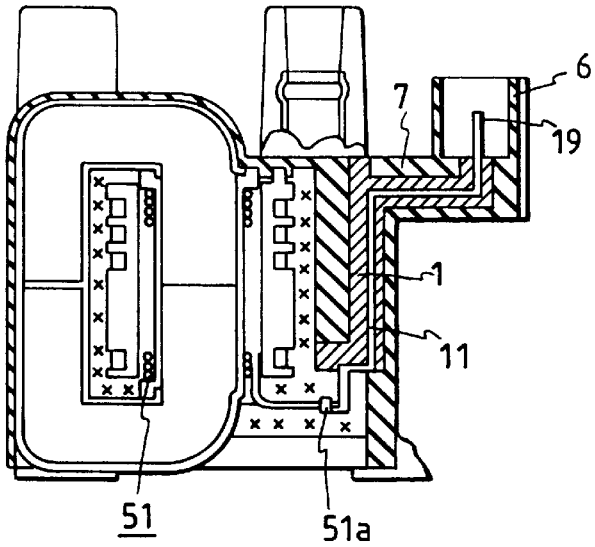
Figure 9A:
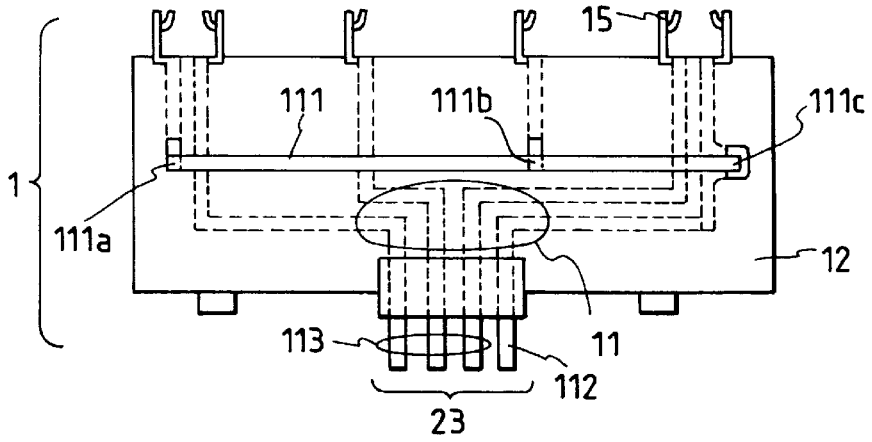
FIGS. 9A and 9B illustrate a further embodiment of the present invention.
Figure 9B:
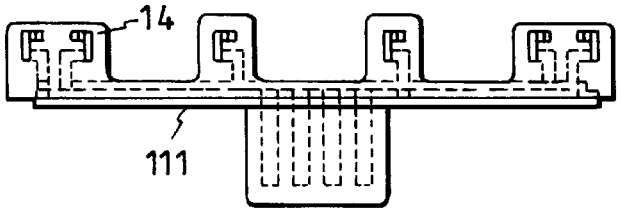
Figure 10:
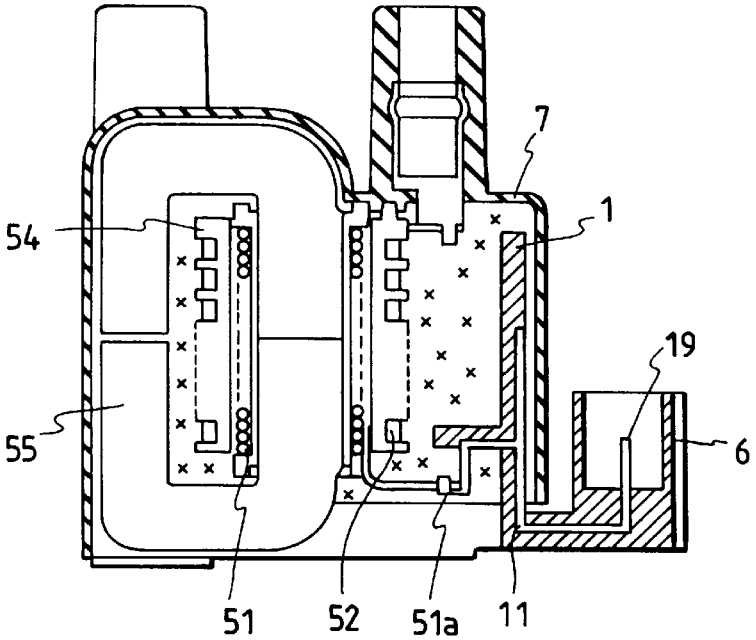
FIG. 10 illustrates a further embodiment of the present invention.

An example in which, unlike the foregoing embodiments, the switching assembly is not incorporated in the ignition coil is shown in FIGS. 8A and 8B. Reference numeral 1 denotes an integrated conductor equivalent to the first integrated conductor shown in the first to fourth embodiments, the integrated conductor being insert-molded in the case 7. In addition, one end of each conductor 11 is fused with the primary winding 51, while the other end thereof forms a connector terminal 19. A detailed form of the integrated conductor is shown in FIGS. 9A and 9B. Reference numeral 11 denotes the plurality of conductors, and one end 15 of the conductors 11 is a fusing terminal portion, while the other end 23 thereof is a connector terminal portion. Here, numeral 112 denotes a terminal for a power supply line; and numeral 113 denotes a terminal connected to the collector of the transistor of the switching assembly. It should be noted that, to make the power supply lines of the plurality of primary windings a common line, conductors 111 are welded at portions 111*a* to 111C.

Also, it goes without saying that the integrated conductor 1 in this embodiment is also fabricated in a process similar to that of the integrated conductor in the first embodiment.

An example is shown in which the integrated conductor 1 shown in the fifth embodiment is post-inserted into the case 7 in the same way as the other components 51 to 55 and the like.

Although a description has been given above of a type in which high-tension towers 59 are formed integrally with the case 7, it goes without saying that the first to sixth embodiments are similarly applicable to a type in which the high-tension towers 59 are formed separately from the case 7.

In addition, although in the foregoing embodiments a case has been shown in which three voltage transforming sections are accommodated in one case, the number of the voltage transforming sections are not confined to three, and similar advantages are obtained even if any number of voltage transforming sections are provided insofar as a plurality of voltage transforming sections are provided.

As described above, in accordance with the present invention, since integrated conductors are used, a plurality of ignition coils and a plurality of switching assemblies can be accommodated in one case, so that the device can be made compact and lightweight. In addition, the wire harness can be disused in the connection between the winding and the switching assembly, so that the device becomes inexpensive and assembly is facilitated. Moreover, since the electrical connection among the coils, the connectors, and the switching assemblies is effected by welding, the reliability of the connections improves. In addition, there is another advantage in that if the housing of the connectors is post-fitted, it is unnecessary to re-fabricate the case in correspondence with the mating connectors.

What is claimed is:

1. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus;

a second integrated conductor in which a plurality of conductors are integrated by a resin, said plurality of conductors respectively connected to the terminals of said switching assemblies, the terminals of said connector, and the terminal of said integrated circuit;

a plurality of voltage transforming sections each voltage transforming section including a plurality of windings having one of an end portion and a terminal;

a first integrated conductor in which a plurality of conductors are integrated by resin, said plurality of conductors connected to said one of winding ends of and the terminals of said plurality of voltage transforming sections; and a case for accommodating first integrated circuit, said second integrated circuit, and said plurality of voltage transforming sections;

wherein a structure adopted is such that said first and second integrated conductors are post-inserted into said case.

2. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus;

a second integrated conductor in which a plurality of conductors are integrated by a resin, said plurality of conductors respectively connected to the terminals of said switching assemblies, the terminals of said connector, and the terminal of said integrated circuit;

a plurality of voltage transforming sections each voltage transforming section including a plurality of windings having one of an end portion and a terminal;

a first integrated conductor in which a plurality of conductors are integrated by resin, said plurality of conductors connected to said one of winding ends of and the terminals of said plurality of voltage transforming sections; and a case for accommodating said plurality of voltage transforming sections;

wherein a structure adopted is such that said first and second integrated conductors are insert-molded into said case.

3. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus;

a second integrated conductor in which a plurality of conductors are integrated by a resin, said plurality of conductors respectively connected to the terminals of said switching assemblies, the terminals of said connector, and the terminal of said integrated circuit;

a plurality of voltage transforming sections each voltage transforming section including a plurality of windings having one of an end portion and a terminal;

a first integrated conductor in which a plurality of conductors are integrated by resin, said plurality of conductors connected to said one of winding ends of and the terminals of said plurality of voltage transforming sections; and a case for accommodating a plurality of transforming sections and having connectors;

wherein one of said integrated conductors has a resiliently retaining portion, and another of said integrated conductors has a fitting portion for said resiliently retaining portion, said first and second integrated conductors being integrated to form a third integrated conductor.

4. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus;

a second integrated conductor in which a plurality of conductors are integrated by a resin, said plurality of conductors respectively connected to the terminals of said switching assemblies, the terminals of said connector, and the terminal of said integrated circuit;

a plurality of voltage transforming sections each voltage transforming section including a plurality of windings having one of an end portion and a terminal; and a first integrated conductor in which a plurality of conductors are integrated by resin, said plurality of conductors connected to said one of winding ends of and the terminals of said plurality of voltage transforming sections;

wherein the terminals are electrically connected to each other by welding.

5. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus;

a second integrated conductor in which a plurality of conductors are integrated by a resin, said plurality of conductors respectively connected to the terminals of said switching assemblies, the terminals of said connector, and the terminal of said integrated circuit, wherein at least one of said conductors is bent after being integrated by the resin, thereby forming a multi-layered structure conductor.

6. An ignition coil as claimed in claim 3, wherein said third integrated conductor in which said first integrated conductor and said second integrated conductor are assembled together; and a case in which said third integrated conductor is insert-molded by an exterior-finishing resin, portions of conductors of said first and second integrated conductors being exposed from the exterior-finishing resin, wherein said third integrated conductor has a resin wall provided in a periphery of said exposed conductors for preventing the influx of the exterior-finishing resin.

7. An ignition coil for an internal combustion engine, comprising:

a plurality of voltage transforming sections, each voltage transforming section including a plurality of windings having one of an end portion and a terminal, at least one bobbin for aligning said windings, and a plurality of iron cores for magnetically coupling said plurality of windings;

a plurality of conductors connected to said one of the winding ends and terminals of said plurality of voltage transforming sections;

a resin part for integrating said plurality of conductors as a first integrated conductor; and a plurality of switching assemblies in each of which a switching circuit for controlling an energizing current for said plurality of windings is sealed by a resin, and which has a terminal, wherein said conductors are connected to said one of said winding ends and terminals of said plurality of voltage transforming sections and to terminals of said switching assemblies, wherein said first integrated conductor connects the terminals of said switching assemblies and said conductors by welding, and wherein resin walls are respectively provided in a periphery of a welded portion between said switching assembly and said conductor and in a periphery of a welded portion between the winding end and said conductor.

8. An ignition coil for an internal combustion engine, comprising:

a plurality of switching assemblies in each of which a power transistor is sealed by a resin and each of which has a terminal;

connector terminals;

a terminal of an integrated circuit incorporated in an apparatus; and a second integrated conductor in which a plurality of conductors are integrated by a resin, said plurality of conductors respectively connected to the terminals of said switching assemblies, the terminals of said connector, and the terminal of said integrated circuit, wherein said second integrated conductor connects the terminals of said switching assemblies and said conductors by welding, and wherein resin walls are respectively provided in a periphery of a welded portion between said switching assembly and said conductor and in a periphery of a welded portion between the winding end and said conductor.

9. An ignition coil for an internal combustion engine, comprising:

a plurality of voltage transforming sections, each voltage transforming section including a plurality of windings having one of an end portion and a terminal, at least one bobbin for aligning said windings, and a plurality of iron cores for magnetically coupling said plurality of windings;

a plurality of conductors connected to said one of the winding ends and terminals of said plurality of voltage transforming sections;

a resin part for integrating said plurality of conductors as a first integrated conductor; and a plurality of switching assemblies in each of which a switching circuit for controlling an energizing current for said plurality of windings is sealed by a resin, and which has a terminal, wherein said conductors are connected to said one of said winding ends and terminals of said plurality of voltage transforming sections and to terminals of said switching assemblies, wherein the winding ends of said plurality of voltage transforming sections and said conductors are electrically connected by welding, and wherein resin walls are respectively provided in a periphery of a welded portion between said switching assembly and said conductor and in a periphery of a welded portion between the winding end and said conductor.

10. An ignition coil for an internal combustion engine, comprising:

a plurality of voltage transforming sections, each voltage transforming section including a plurality of windings having one of an end portion and a terminal, at least one bobbin for aligning said windings, and a plurality of iron cores for magnetically coupling said plurality of windings;

a plurality of conductors connected to said one of the winding ends and terminals of said plurality of voltage transforming sections;

a resin part for integrating said plurality of conductors as a first integrated conductor; and a case for accommodating said plurality of voltage transforming sections and having connectors, wherein said conductors have end portions each forming a connector terminal, and said first integrated conductor is post-inserted into said case, wherein said first integrated conductor is insert-molded with molding of said case so as to form connector terminals, and wherein said case is insert-molded to form connector terminals, and a connector housing is separately post-inserted with the case.

11. An ignition coil as claimed in claim 10, wherein the connector housing of a different shape is mounted in accordance with a usage.

* * * * *